US012378852B2

(12) United States Patent
Zahran et al.

(10) Patent No.: US 12,378,852 B2
(45) Date of Patent: Aug. 5, 2025

(54) FLEXIBLE ANVIL FOR A PLUNGER LIFT SYSTEM

(71) Applicant: Saudi Arabian Oil Company, Dhahran (SA)

(72) Inventors: Amr Mohamed Zahran, Al Khobar (SA); Syed Muhammad Bin Syed Taha, Dhahran (SA); Mohamed Sayed, Dammam (SA); Gustavo Alvarez, Dhahran (SA); Bagus Wahyu Setiadi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/239,625

(22) Filed: Aug. 29, 2023

(65) Prior Publication Data

US 2025/0075601 A1 Mar. 6, 2025

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/12; E21B 43/122; E21B 43/121; F04B 47/12
See application file for complete search history.

(56) References Cited

U.S. PATENT DOCUMENTS 2,038,426 A 4/1936 Fletcher
2,577,210 A 12/1951 Ruska
2,610,644 A 9/1952 Carlisle et al.
2,676,547 A 4/1954 Knox
2,762,308 A 9/1956 Tomlinson
3,150,596 A 9/1964 Knox
(Continued)

FOREIGN PATENT DOCUMENTS

CA 2164145 11/1996
CA 2527012 11/2005
(Continued)

OTHER PUBLICATIONS

Apergy Unlocking Energy, "PCS Multi-Stage Plunger Lift Equipment Catalog, Plunger Lift: Multi-Stage Plunger Tools," Oct. 2018, 2 pages.

(Continued)

*Primary Examiner* — D. Andrews
(74) *Attorney, Agent, or Firm* — Fish & Richardson P.C.

(57) ABSTRACT

Implementations of the present disclosure include a wellbore assembly that includes a wellhead assembly and a plunger. The wellhead assembly is coupled to a wellbore string disposed within a wellbore. The wellhead assembly includes a lubricator, a spring, and a flexible damper. The lubricator defines a tubular housing. The spring is disposed at least partially within and attached to the tubular housing. The spring comprises a first end attached to the tubular housing. The flexible damper is coupled to a second end of the spring opposite the first end. The plunger strikes, as the plunger is lifted from a downhole location of the wellbore to the terranean surface, the flexible damper. The flexible damper deforms, upon impact with the plunger, to dissipate some or all of the kinetic energy of the plunger.

18 Claims, 4 Drawing Sheets

(56) References Cited

U.S. PATENT DOCUMENTS

| | | | | |
|---|---|---|---|---|
| 3,735,815 | A | 5/1973 | Myers | |
| 3,749,119 | A | 7/1973 | Tausch et al. | |
| 3,797,818 | A * | 3/1974 | Willich | F16F 9/346 293/134 |
| 4,009,753 | A | 3/1977 | McGill et al. | |
| 4,043,392 | A | 8/1977 | Gazda | |
| 4,211,279 | A | 7/1980 | Isaacks | |
| 4,366,861 | A | 1/1983 | Milam | |
| 4,531,228 | A | 7/1985 | Kazunori et al. | |
| 4,596,516 | A | 6/1986 | Scott et al. | |
| 4,723,606 | A | 2/1988 | Vinzant | |
| 4,813,481 | A | 3/1989 | Sproul et al. | |
| 5,211,242 | A | 5/1993 | Coleman et al. | |
| 5,263,683 | A | 11/1993 | Wong | |
| 5,271,725 | A | 12/1993 | Freet et al. | |
| 5,389,128 | A | 2/1995 | Lopes | |
| 5,472,054 | A | 12/1995 | Hinds | |
| 5,516,360 | A | 5/1996 | Normandeau et al. | |
| 5,653,286 | A | 8/1997 | McCoy et al. | |
| 5,823,265 | A | 10/1998 | Crow | |
| 5,902,378 | A | 5/1999 | Obrejanu | |
| 6,079,491 | A | 6/2000 | Stuebinger et al. | |
| 6,089,322 | A | 7/2000 | Kelley et al. | |
| 6,092,599 | A | 7/2000 | Berry et al. | |
| 6,092,600 | A | 7/2000 | McKinzie | |
| 6,131,660 | A | 10/2000 | Stuebinger et al. | |
| 6,138,758 | A | 10/2000 | Shaw et al. | |
| 6,148,923 | A | 11/2000 | Casey | |
| 6,155,345 | A | 12/2000 | Lee et al. | |
| 6,179,056 | B1 | 1/2001 | Smith | |
| 6,216,788 | B1 | 4/2001 | Wilson | |
| 6,179,054 | B1 | 10/2001 | Stewart | |
| 6,367,547 | B1 | 4/2002 | Towers et al. | |
| 6,481,499 | B2 | 11/2002 | Lopes | |
| 6,494,258 | B1 | 12/2002 | Weingarten | |
| 6,571,868 | B2 | 6/2003 | Victor | |
| 6,705,404 | B2 | 3/2004 | Bosley et al. | |
| 6,736,880 | B2 | 5/2004 | Ford et al. | |
| 6,808,020 | B2 | 10/2004 | Garcia | |
| 6,830,108 | B2 | 12/2004 | Rogers | |
| 6,932,160 | B2 | 8/2005 | Murray | |
| 6,945,762 | B2 | 9/2005 | Williams | |
| 6,966,366 | B2 | 11/2005 | Rogers | |
| 7,080,692 | B1 | 7/2006 | Kegin | |
| 7,188,670 | B2 | 3/2007 | Amies et al. | |
| 7,337,854 | B2 | 3/2008 | Horn et al. | |
| 7,665,528 | B2 | 2/2010 | Ross et al. | |
| 7,954,545 | B2 | 6/2011 | Hearn et al. | |
| 8,136,600 | B2 | 3/2012 | Fowler | |
| 8,181,706 | B2 | 5/2012 | Tanton | |
| 8,286,717 | B2 | 10/2012 | Giroux et al. | |
| 8,322,434 | B2 | 12/2012 | Fielding | |
| 8,424,611 | B2 | 4/2013 | Smith | |
| 8,475,147 | B2 | 7/2013 | Losinske | |
| 8,893,777 | B1 | 11/2014 | Garrett | |
| 8,950,473 | B2 | 2/2015 | Smith | |
| 8,985,221 | B2 | 3/2015 | Mazzanti | |
| 9,109,424 | B2 | 8/2015 | Jefferies et al. | |
| 9,206,676 | B2 | 12/2015 | Quigley et al. | |
| 9,322,251 | B2 | 4/2016 | Mazzanti | |
| 9,470,073 | B2 | 10/2016 | Xiao et al. | |
| 9,518,458 | B2 | 12/2016 | Ellithorp | |
| 9,587,444 | B2 | 3/2017 | Agarwal | |
| 9,631,472 | B2 | 4/2017 | Reid et al. | |
| 9,670,758 | B2 | 6/2017 | Wilson | |
| 9,765,608 | B2 | 9/2017 | Sims | |
| 9,915,256 | B2 | 3/2018 | Bebak et al. | |
| 9,970,420 | B2 | 5/2018 | Wang et al. | |
| 10,174,752 | B2 | 1/2019 | Downing | |
| 10,364,658 | B2 | 7/2019 | Michel | |
| 10,697,287 | B2 | 6/2020 | Romer et al. | |
| 10,920,559 | B2 | 2/2021 | Zahran | |
| 11,255,170 | B2 | 2/2022 | Zahran | |
| 11,261,713 | B2 | 3/2022 | Zahran | |
| 11,261,859 | B2 | 3/2022 | Zahran | |
| 11,542,797 | B1 | 1/2023 | Zahran et al. | |
| 2002/0162662 | A1 | 11/2002 | Passamaneck | |
| 2003/0215337 | A1 | 11/2003 | Lee | |
| 2004/0238179 | A1 | 12/2004 | Murray | |
| 2005/0053503 | A1 | 3/2005 | Gallant | |
| 2005/0194149 | A1 | 9/2005 | Giaconnino | |
| 2005/0199551 | A1 | 9/2005 | Gordon | |
| 2006/0113072 | A1 | 6/2006 | Lee | |
| 2006/0249284 | A1 | 11/2006 | Victor | |
| 2006/0283791 | A1 | 12/2006 | Ross | |
| 2008/0135239 | A1 | 6/2008 | Edwards | |
| 2008/0210429 | A1 | 9/2008 | Mcmillin et al. | |
| 2008/0230230 | A1 | 9/2008 | Giacomino | |
| 2009/0038788 | A1 | 2/2009 | Farris | |
| 2009/0139049 | A1 * | 6/2009 | Bantle | F16F 7/09 16/84 |
| 2010/0038071 | A1 | 2/2010 | Scott et al. | |
| 2010/0147514 | A1 | 6/2010 | Swaringin | |
| 2010/0294507 | A1 | 11/2010 | Tanton | |
| 2011/0067879 | A1 * | 3/2011 | Kleppa | E21B 34/08 166/326 |
| 2011/0073322 | A1 | 3/2011 | Smith et al. | |
| 2011/0132593 | A1 | 6/2011 | Phloi-montri | |
| 2011/0226464 | A1 * | 9/2011 | Zabelka | E21B 33/03 166/70 |
| 2012/0318524 | A1 | 12/2012 | Lea | |
| 2013/0068455 | A1 | 3/2013 | Brown et al. | |
| 2013/0319661 | A1 | 12/2013 | Xiao et al. | |
| 2015/0233228 | A1 | 8/2015 | Roth et al. | |
| 2015/0240596 | A1 | 8/2015 | Horwell | |
| 2015/0275633 | A1 | 10/2015 | Tolman et al. | |
| 2015/0292307 | A1 | 10/2015 | Best | |
| 2016/0130922 | A1 | 5/2016 | Wilson | |
| 2016/0222773 | A1 | 8/2016 | Sims | |
| 2016/0333681 | A1 | 11/2016 | Mazzanti | |
| 2017/0044882 | A1 | 2/2017 | Casey et al. | |
| 2017/0044883 | A1 | 2/2017 | Wilkinson et al. | |
| 2017/0081952 | A1 | 3/2017 | Osborne et al. | |
| 2017/0096884 | A1 | 4/2017 | Michel | |
| 2017/0218722 | A1 | 8/2017 | Gordon | |
| 2017/0328189 | A1 | 11/2017 | Wang et al. | |
| 2018/0196005 | A1 | 7/2018 | Fanini et al. | |
| 2018/0334890 | A1 | 11/2018 | Stadler et al. | |
| 2019/0292892 | A1 | 9/2019 | Zahran | |
| 2020/0141214 | A1 | 5/2020 | Kuykendall | |
| 2020/0386087 | A1 | 12/2020 | Gaglioti | |
| 2021/0032964 | A1 | 2/2021 | Zahran | |
| 2021/0102597 | A1 * | 4/2021 | Romer | F16F 9/535 |
| 2021/0301635 | A1 | 9/2021 | Zahran | |
| 2024/0052728 | A1 | 2/2024 | Zahran et al. | |
| 2024/0159233 | A1 | 5/2024 | Taha et al. | |
| 2024/0159234 | A1 | 5/2024 | Taha et al. | |

FOREIGN PATENT DOCUMENTS

| | | | |
|---|---|---|---|
| CA | 2875423 A1 * | 6/2015 | E21B 17/07 |
| CN | 2336113 | 9/1999 | |
| CN | 201314221 | 9/2009 | |
| CN | 203035167 | 7/2013 | |
| CN | 203603854 | 5/2014 | |
| CN | 205189837 | 4/2016 | |
| CN | 109209305 | 1/2019 | |
| CN | 216406782 | 4/2022 | |
| EP | 2142755 | 3/2016 | |
| GB | 2257185 | 1/1993 | |
| GB | 2409691 | 2/2007 | |
| GB | 2452370 | 3/2009 | |
| WO | WO 2015167895 | 11/2015 | |
| WO | WO 2016057011 | 4/2016 | |

OTHER PUBLICATIONS

Don-nan.com [online], "Gas Separator: Packer-style gas separator," available on or before Apr. 10, 2012, [retrieved on Sep. 7, 2018], retrieved from : URL <https://irp-cdn.multiscreensite.com/4497d96c/files/uploaded/DN%20GS%20PS.pdf>, 1 page.

(56) References Cited

OTHER PUBLICATIONS

Gray, "Well-Performance Diagnostics Using Smart Plunger Technology," SPE 120596-MS, SPE International, SPE Production and Operations Symposium, Oklahoma City, Oklahoma, Apr. 2009, 10 pages.
Harbison Fisher, "Variable Slippage Pump," 2001, [retrieved on Mar. 15, 2021], retrieved from: URL <http://apergycdn.5thring.co.uk/HF_Variable_Slippage_Pump.pdf>, 8 pages.
Lufkin Oilfield Products Group, "2008/2009 General Catalog," 2008-2009, 72 pages.
McCoy et al. "Improved Downhole Gas Separators," presented at the Southwestern Petroleum Short Course, Apr. 7-8, 1998, 11 pages.
McCoy et al., "Downhole Gas Separators: A Laboratory and Field Study," presented at the Gas Well De-Liquification Workshop, Feb. 27-Mar. 1, 2006, 47 pages.
Odessaseparator.com [online], "OSI: Fluid Conditioning Systems," available on or before Apr. 7, 2017, via Internet Archive: Wayback Machine URL <https://web.archive.org/web/20170407235934/http://www.odessaseparator.com/products>, retrieved on Sep. 7, 2018, retrieved from URL <https://www.odessaseparator.com/products>, 4 pages.
Samayamantula, "An Innovative Design for Downhole Gas Separation," Don-Nan Pump and Supply Company, presented at the Oil and Gas Technology Webinar hosted by IEEE, Engineering 360, May 22, 2013, 16 pages.
Valbuena et al., "Defining the Artificial Lift System Selection Guidelines for Horizontal Wells," SPE-181229-MS, Society of Petroleum Engineers (SPE), presented at the SPE North American Artificial Lift Conference and Exhibition, Oct. 25-27, 2016, 20 pages.
Xu et al., "Rod Pumping Deviated Wells," Lufkin Automation, 2005, 14 pages.
U.S. Appl. No. 18/240,001, Zahran et al., Multi-Stage Plunger Hydrocarbon Lifting, filed Aug. 30, 2023, 26 pages.
U.S. Appl. No. 18/523,267, Setiadi et al., Plunger Lift System, filed Nov. 29, 2023, 36 pages.
U.S. Appl. No. 18/523,293, Setiadi et al., Production Method With a Plunger Lift System, filed Nov. 29, 2023, 35 pages.
U.S. Appl. No. 18/523,308, Setiadi, Collar Detector, filed Nov. 29, 2023, 32 pages.
International Search Report and Written Opinion in International Appln. No. PCT/US2024/043154, mailed on Dec. 4, 2024, 14 pages.

* cited by examiner

FLEXIBLE ANVIL FOR A PLUNGER LIFT SYSTEM

TECHNICAL FIELD

This disclosure relates to productions systems, and more particularly to plunger lift systems.

BACKGROUND

Plunger lift systems use plungers to lift hydrocarbons to the surface of a wellbore. Plunger lift systems use lubricators that receive the plunger when the plunger is lifted to the surface. Plunger lift system can fail due to the large impact force of the plunger, which can delay production and cause other issues. Improvement in plunger lift systems are sought.

SUMMARY

Implementations of the present disclosure include a wellbore assembly that includes a wellhead assembly and a plunger. The wellhead assembly is coupled to a wellbore string disposed within a wellbore. The wellhead assembly is configured to reside at a terranean surface of the wellbore. The wellhead assembly includes a lubricator, a spring, and a flexible damper. The lubricator defines a tubular housing. The spring is disposed at least partially within and attached to the tubular housing. The spring comprises a first end attached to the tubular housing. The flexible damper is coupled to a second end of the spring opposite the first end. The plunger strikes, as the plunger is lifted from a downhole location of the wellbore to the terranean surface, the flexible damper. The flexible damper deforms, upon impact with the plunger, to dissipate some or all of the kinetic energy of the plunger.

In some implementations, the flexible damper comprises a flexible tube comprising bellows that allows the flexible tube to be compressed upon impact.

In some implementations, the tube comprises a non-metallic, hollow tube.

In some implementations, the tube is filled with hydraulic fluid.

In some implementations, the flexible damper has a rigid impact surface and a guide rod, with the flexible tube attached to and disposed between the guide rod and the impact surface.

In some implementations, the flexible damper has a non-metallic housing defining an inner volume configured to house a hydraulic fluid.

In some implementations, the non-metallic housing comprises a rubber bag filled with hydraulic fluid. In some implementations, the tubular housing comprises a widened portion configured to accommodate the rubber bag as the rubber bag expands radially upon impact.

Implementations of the present disclosure include an anvil that includes a rigid base configured to be coupled to an end of a compression spring disposed within a plunger lubricator of a wellbore, and a flexible damper coupled to the rigid base opposite the compression spring. The flexible damper is configured to dissipate some or all of the kinetic energy from a plunger upon impact from the plunger during a plunger lifting process of the wellbore.

In some implementations, the flexible damper comprises a flexible tube comprising bellows that allows the flexible tube to be compressed upon impact.

In some implementations, the tube comprises a non-metallic, hollow tube.

In some implementations, the tube is filled with hydraulic fluid.

In some implementations, the flexible tube comprises an accordion-style tube made of rubber.

In some implementations, the rigid base comprises a metal plate and the rigid guide rod comprises a metal rod.

In some implementations, the anvil further comprising a second metal plate comprising an impact surface and coupled to an end of the flexible tube opposite the metal plate.

In some implementations, the flexible damper comprises a non-metallic housing defining an inner volume configured to house a hydraulic fluid.

In some implementations, the anvil further comprising a rigid guide rod configured to be disposed at least partially within the compression spring, and wherein the non-metallic housing comprises a rubber bag filled with hydraulic fluid and configured to expand radially upon impact by the plunger.

Implementations of the present disclosure include a method that includes lifting, with production fluid accumulated uphole of a plunger, the plunger within a production string disposed within a wellbore. The lifting comprises lifting the plunger to push the production fluid uphole. The method also includes continuing to lift the plunger until the plunger strikes a flexible anvil coupled to a distal end of a spring of a wellhead lubricator, the flexible anvil configured to dissipate some or all of the kinetic energy from the plunger.

In some implementations, the flexible anvil comprises a flexible tube comprising bellows, and continuing to lift the plunger comprises lifting the plunger until the plunger strikes the flexible tube compressing the bellows of the flexible tube.

In some implementations, the flexible anvil comprises a rubber bag filled with hydraulic fluid, and continuing to lift the plunger comprises lifting the plunger until the plunger strikes the rubber bag and expand the rubber bag radially for the rubber bag to absorb some or all of the kinetic energy.

Particular implementations of the subject matter described in this specification can be implemented so as to realize one or more of the following advantages. For example, the flexible anvil of the present disclosure helps reduce the amount of kinetic energy transferred to the lubricator spring and the lubricator body, which can help improve the performance and increase the life of the lubricator. Additionally, the flexible anvil can be used with different plungers and in different plunger lift systems, which can save time and resources.

DETAILED DESCRIPTION OF THE DISCLOSURE

The present disclosure describes a plunger lift system that includes a lubricator with a flexible anvil. Plunger lift systems use a form of intermittent gas lift method that includes using gas pressure buildup in the casing-tubing annulus to push a plunger up from the bottom of the plunger. The plunger is dropped from the terranean surface of the wellbore and falls through the fluid in the production string, allowing fluid to flow across the plunger in an uphole direction until the plunger lands at the lower spring assembly of the artificial plunger lift system. Once the plunger lands at the lower spring assembly, the plunger closes at impact, preventing fluid from flowing across the plunger in any direction. Thus, the pressurized gas entering the production string from the downhole end pushes up the plunger and causes the plunger to push the fluid uphole to the terranean surface. Once the fluid is flowed out of the wellbore, the annulus is depressurized and the plunger falls down to begin the process again. In some cases, the plunger can be a flow-through plunger that allows the production cycle to continue without shutting in the wellbore.

Figure 1:
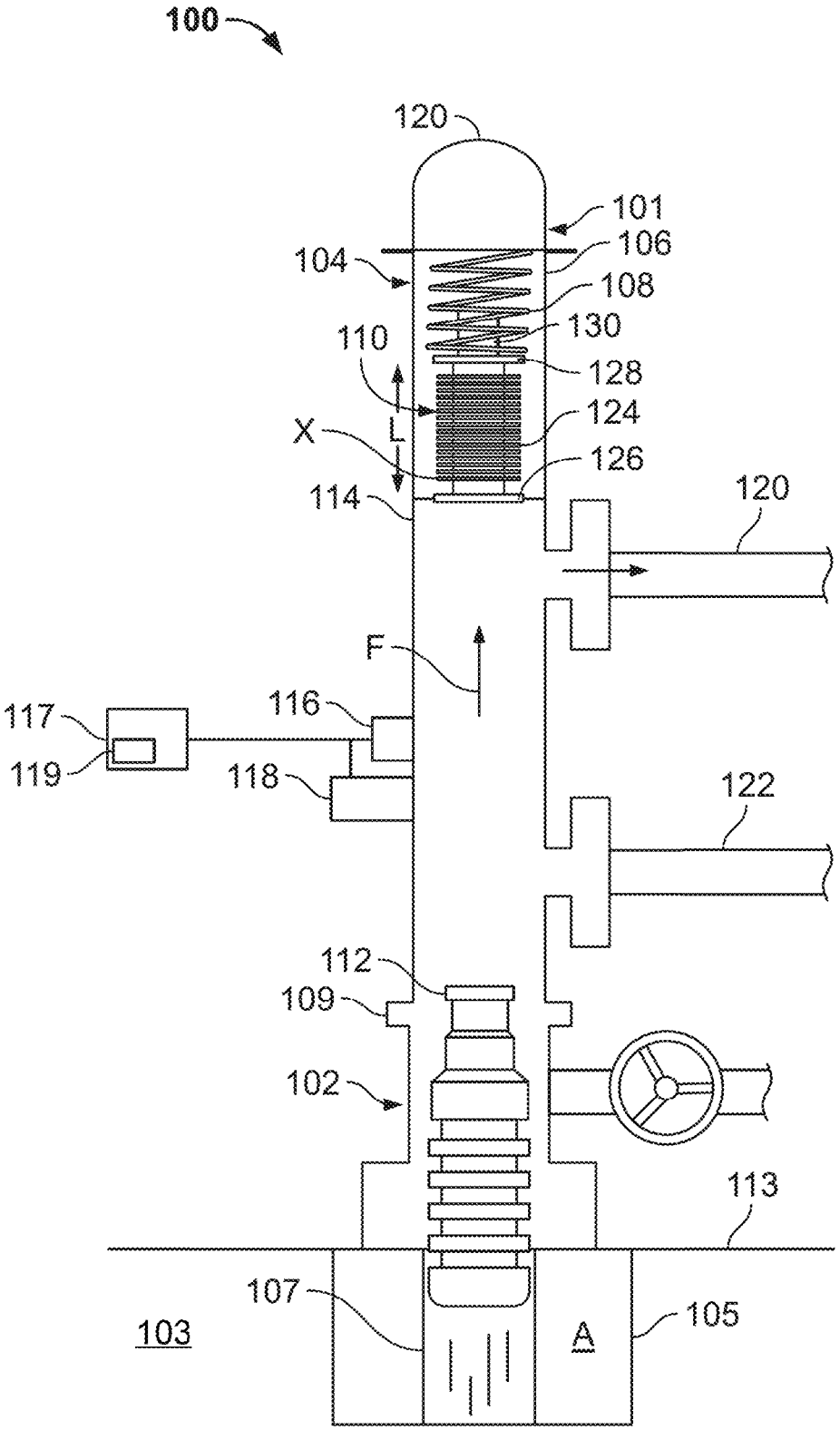
FIGS. 1-3 are sequential, front schematic views of steps to lift a plunger to a lubricator assembly according to a first embodiment of the present disclosure.

FIG. 1 shows a wellbore assembly 100 that includes a wellhead assembly 101, a wellbore string 107 (e.g., a production string or production tubing), and a plunger 112. The production string 107 resides within a wellbore 105 and defines, with the wall of the wellbore, an annulus "A." The wellbore 105 extends through a subterranean zone 103 that includes a geologic formation (not shown). For example, the wellbore 105 extends down from a surface 113 (e.g., a terranean surface) of the wellbore 105 and is formed in the geologic formation. The geologic formation includes a hydrocarbon reservoir (not shown) from which hydrocarbons can be extracted.

The wellhead assembly 101 includes a wellhead 102 and a lubricator assembly 104. The wellhead 102 resides at or near the terranean surface 113 of the wellbore 105, and is the lowermost part of the wellhead assembly 101. In some aspects, the wellhead 102 includes wellhead components (not shown) such as a casing head, a conductor casing, a tubing spool, casing hangers, etc.

The lubricator assembly 104 is attached to and disposed above the wellhead 102. The lubricator assembly 104 can be attached to the wellhead assembly 102 through a flange 109 (e.g., a bolted flange). The lubricator assembly 104 includes a lubricator 106 and a flexible anvil 110 or damper. The lubricator 106 has a tubular housing 114 that receives the plunger 112 and fluid "F" (e.g., production fluid such as hydrocarbons) from the wellbore 105. The lubricator 106 includes a spring 108, a sensor 116, a catcher 118, and a cap 120.

The spring 108 resides at least partially within the tubular housing 114. The top end of the spring 108 is attached to the tubular housing 114 and its second, opposite end is attached to the flexible anvil 110. The second end of the spring 108 receives a portion of the flexible anvil 110.

The flexible anvil 110 includes a flexible element 124 such as a rubber block, a tubber tube, or non-metallic, hollow tube. In some aspects, the flexible element 124 is a bellow or accordion-style rubber tube or a rubber bag. The flexible element is sandwiched between two rigid plates 126, 128. The lower plate 126 has an impact surface that the plunger 112 strikes and the upper plate 128 is attached to a guide rod 130 inserted into the spring 108. The upper plate 128 is attached to the second end of the spring 108. The flexible element can be made of rubber, plastic, silicone, or a similar material. The flexible tube 124 has bellows that allow the flexible tube to be compressed axially upon impact, which in turn absorbs the impact energy from the plunger 112. In some aspects, the flexible element 124 has a length "L" of, for example, between 3 and 40 inches (or more) when suspended from the spring before impact.

The lubricator 106 serves as the impact tool for plungers 112 arriving on surface. The cap 120 can be opened to lubricate the components and plunger 112 within the lubricator 106. The spring 108 and flexible anvil 110 absorb the impact of the plunger 112. For example, when the plunger 112 is lifted from a downhole location to the surface, the plunger strikes the flexible anvil 110. The flexible anvil 110 elastically deforms (e.g., flexes) to dissipate some or all of the kinetic energy of the plunger 112. For example, the flexible anvil converts some or all of the energy into heat or potential energy. In some aspects, the flexible anvil 110 transmits some of the kinetic energy from the plunger 112 to the spring 108, which in turn converts the kinetic energy into potential energy.

In some aspects, once the plunger 102 strikes the anvil 110, the catcher 118 catches the plunger 112, preventing the plunger 112 from falling downhole. The catcher 118 is activated in response to sensor feedback. For example, the sensor 116 is communicatively coupled to a controller 117. The controller receives feedback from the sensor 116, processes the feedback, and transmits instructions to the catcher 118 to activate the catcher 118.

In some aspects, the controller 117 can be implemented as a distributed computer system disposed partly at the surface and partly within the wellbore. The computer system includes one or more processors 119 and a computer-readable medium storing instructions executable by the one or more processors to perform the operations described here. In some implementations, the controller 117 can be implemented as processing circuitry, firmware, software, or combinations of them. The controller 117 transmits signals to the catcher to catch and release the plunger 112.

In some aspects, the sensor 116 is a motion sensor or a radio frequency sensor. Additionally, the sensor 116 can include one or more sensors that sense movement, pressure, flow rate, noise, or other parameters that can be used to determine the location (or presence) of the plunger 112. Additionally, the catcher 118 can be automatically or manually operated, and can include a threaded fastener, a spring-loaded rod, a linear actuator, a clamp, a pin, or a similar device. The sensor 116 and catcher 118 can be part of the lubricator 106 or the wellhead 102 or another component of the wellhead assembly 101.

As the production fluid "F" lifted by the plunger 112 reaches the lubricator assembly 104, the production fluid "F" flows out of the lubricator assembly 104 through one or more pipes 120, 122 to a surface flow line (not shown). Once the production fluid "F" has been brought to the surface 113 and routed out of the lubricator 106, the catcher 118 can disengage the plunger 112, allowing the plunger to fall within the wellbore to begin another cycle of the plunger lift system. The production string 107 also includes a bottom hole landing assembly (not shown) that includes a bumper spring and tubing stop or standing valve that receives the landing plunger 112.

The plunger 112 is lifted by the natural pressure of the wellbore 105 or artificially, by fluid injected through the annulus "A." For example, a pump (not shown) flows gas downhole through the annulus "A", which enters the production string below the plunger 112 to lift the plunger 112.

Figure 2:
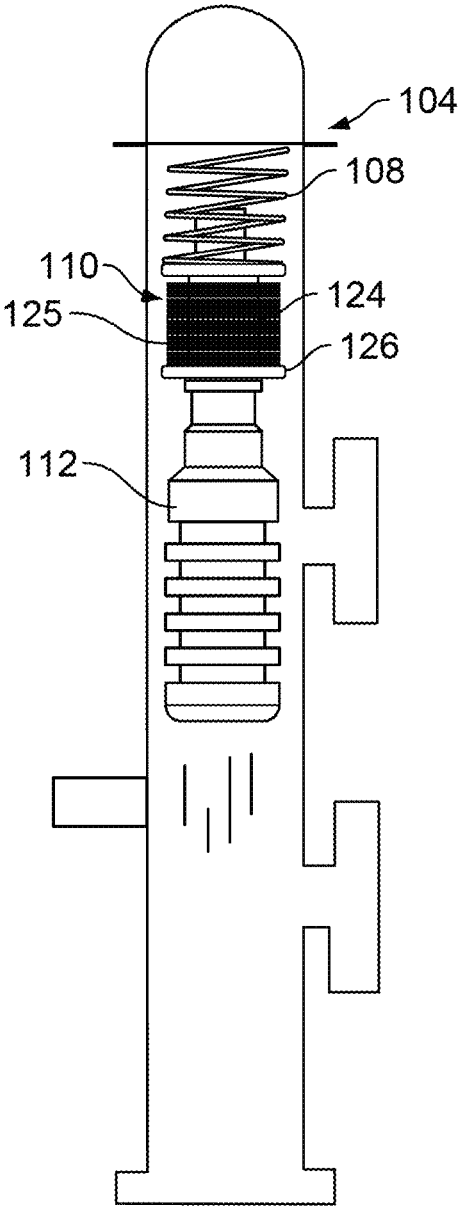
Figure 3:
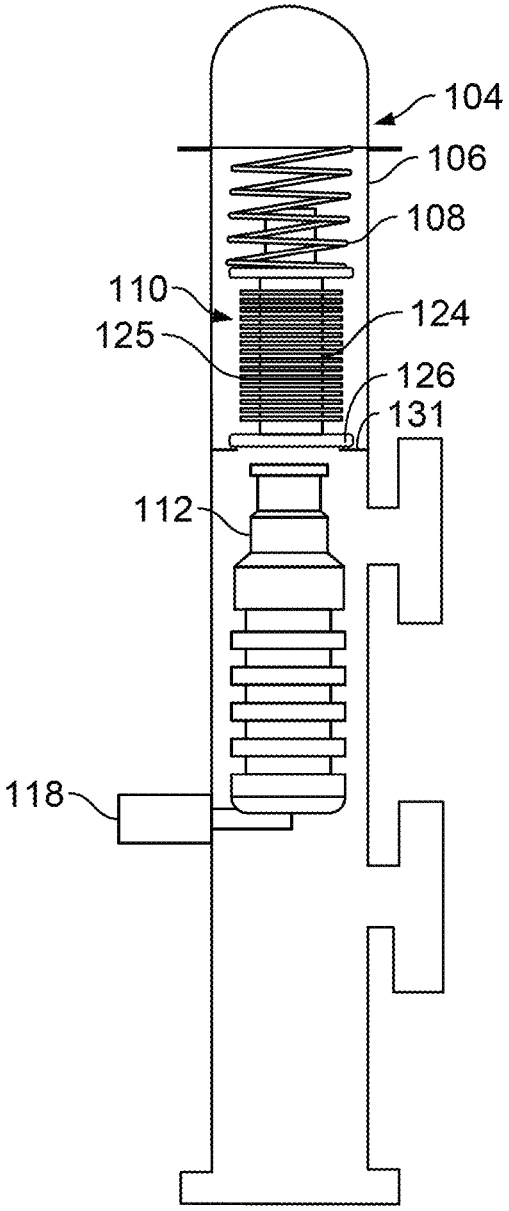

FIGS. 2 and 3 show the plunger 112 during impact and after impact, respectively. For simplicity purposes, FIGS. 2 and 3 show only parts of the lubricator assembly 101. FIG. 2 shows the plunger striking the flexible anvil 110. The bellows 125 of the flexible anvil 125 fold or compress to allow the flexible anvil 110 to compressed upon impact. The spring 108 can also absorb some of the kinetic energy of the plunger 112.

In some aspects, the flexible tube 124 is filled with hydraulic fluid. In some aspects, the flexible rube 124 is designed to maintain its shape while suspended from the spring to keep the tube 124 from stretching under its own weight when hung on the spring 108 (or to keep the tube from compressing under its own weight when standing). In some aspects, the flexible tube 124 is designed such that the tube 124 is elongated under its own weight when hanging on the spring 108. For example, the stiffness of the tube or an amount of fluid within the tube can be calculated (and changed) such that the tube has the desired characteristics (e.g., stiffness) for the lift process. Thus, the flexible tube 124 can be compressed a desired amount upon impact from the plunger 112.

Referring to FIG. 3, after impact, the spring 108 and flexible anvil 110 extend back to their original position and the plunger 112 is retained by the catcher 118. The catcher 118 extends an arm into the housing to prevent the plunger 112 from falling down into the wellbore. In some aspects, the lubricator 106 has an inwardly-projecting shoulder 131 that retains the lower plate 126 of the flexible anvil 110 when the tube 124 extends.

Figure 4:
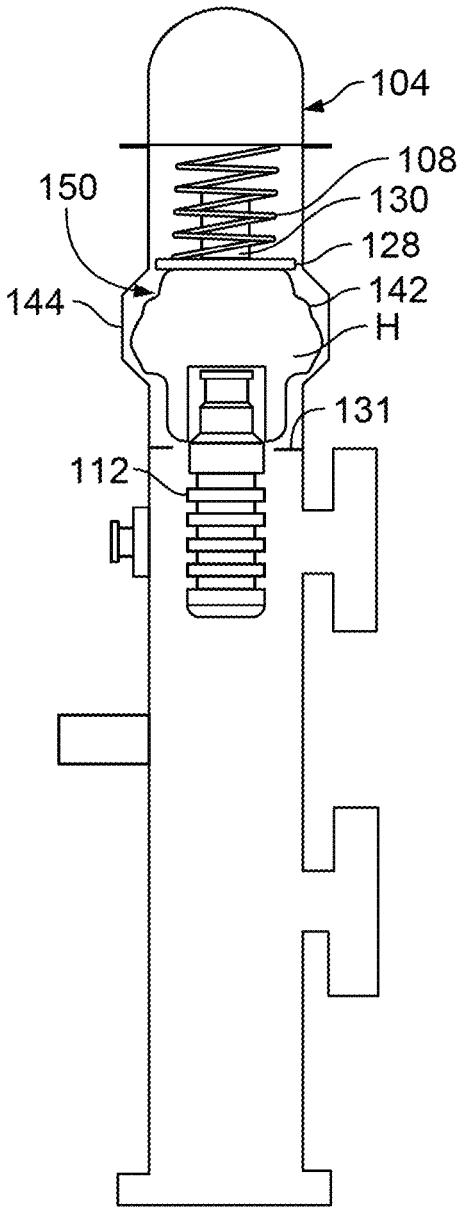
FIGS. 4-5 are sequential, front schematic views of steps to lift a plunger to a lubricator assembly according to a second embodiment of the present disclosure.
Figure 5:
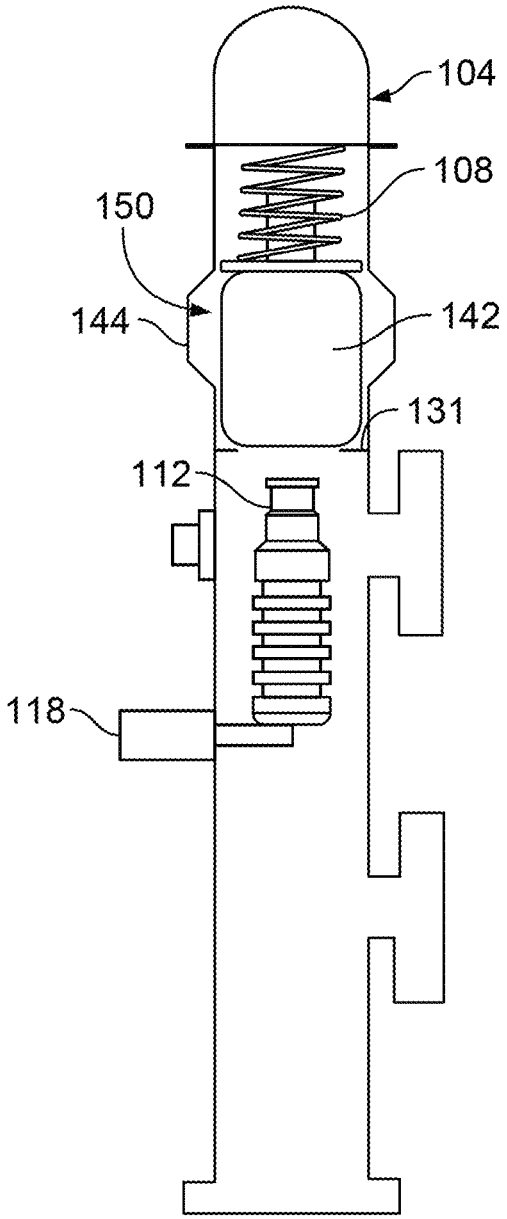

FIGS. 4 and 5 show the lubricator assembly 104 according to a different implementation. The lubricator assembly 104 includes a flexible anvil 150 that has a flexible bag 142 (e.g., a rubber bag) filled with hydraulic fluid "H." As shown in FIG. 4, the housing of the lubricator assembly 104 has a widened portion or housing 144 that accommodates the rubber bag 142 as the rubber bag 142 expands radially to absorb the impact energy of the plunger 112. Thus, when the plunger 112 strikes the bag 142, the bag expands sideways into the wide housing 144 of the lubricator.

In some aspects, during impact, the hydraulic fluid "H" stays within the bag 142 so that the amount of fluid "H" within the bag does not change. This forces the bag to expand sideways upon impact to accommodate the deformation of the bag. In some aspects, the hydraulic fluid "H" can leave the bag 142 in a controlled manner, similar to a vehicle shock absorber, allowing an amount of fluid to flow into a second housing when the bag is deformed to absorb the energy of the plunger 112 and prevent the bag 142 from expanding or stretching significantly.

The rubber bag 142 is attached to a rigid plate 128 and a guide rod 130, similar to the guide rod of the flexible anvil in FIGS. 1-3. The rigid plate 128 separates the spring 108 from the flexible bag 142. The guide rod 130 is disposed at least partially within the compression spring 108 that also absorbs some of the kinetic energy of the plunger 112. The guide rod 130 can help keep the bag 142 substantially centered, along a central axis of the spring 108.

As shown in FIG. 5, after impact the rubber bag 142 returns to its normal shape and the plunger 112 bounces back to be retained by the lubricator catcher 118. The rubber bag 142 expands back and is retained by the inner shoulder 131 of the lubricator.

Figure 6:
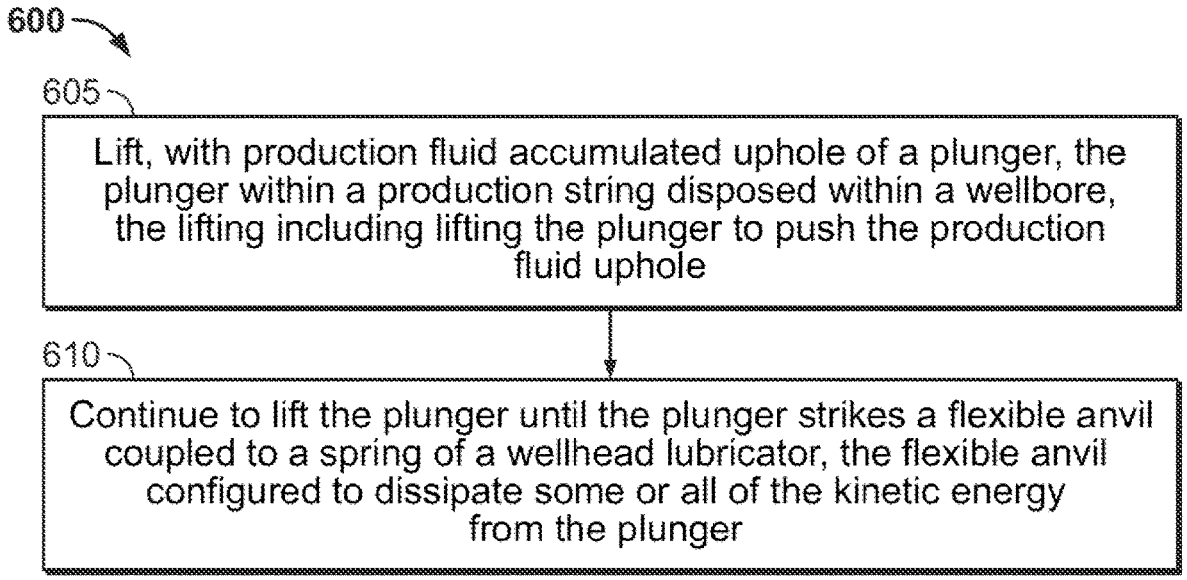
FIG. 6 is a flow chart of a plunger lift method.

FIG. 6 shows a flow chart of a method (600) of lifting hydrocarbons with a plunger. The method includes dropping a plunger within a wellbore so that the plunger falls within the wellbore until reaching downhole end of the production string (605). The method also includes lifting, after fluid has accumulated uphole of the plunger, the plunger along the wellbore (610). The method also includes continuing to lift the plunger until the plunger strikes a flexible anvil coupled to a spring of a wellhead lubricator, the flexible anvil configured to dissipate some or all of the kinetic energy from the plunger (615).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

The following examples are innovative:

Example 1 is a wellbore assembly that includes a wellhead assembly and a plunger. The wellhead assembly is coupled to a wellbore string disposed within a wellbore. The wellhead assembly is configured to reside at a terranean surface of the wellbore. The wellhead assembly includes a lubricator, a spring, and a flexible damper. The lubricator defines a tubular housing. The spring is disposed at least partially within and attached to the tubular housing. The spring comprises a first end attached to the tubular housing. The flexible damper is coupled to a second end of the spring opposite the first end. The plunger strikes, as the plunger is lifted from a downhole location of the wellbore to the terranean surface, the flexible damper. The flexible damper deforms, upon impact with the plunger, to dissipate some or all of the kinetic energy of the plunger.

Example 2 includes example 1, wherein the flexible damper comprises a flexible tube comprising bellows that allows the flexible tube to be compressed upon impact.

Example 3 includes any of examples 1-2, wherein the tube comprises a non-metallic, hollow tube.

Example 4 includes any of examples 1-3, wherein the tube is filled with hydraulic fluid.

Example 5 includes any of examples 1-4, wherein the flexible damper has a rigid impact surface and a guide rod, with the flexible tube attached to and disposed between the guide rod and the impact surface.

Example 6 includes any of examples 1-5, wherein the flexible damper has a non-metallic housing defining an inner volume configured to house a hydraulic fluid.

Example 7 includes any of examples 1-6, wherein the non-metallic housing comprises a rubber bag filled with hydraulic fluid.

Example 8 includes any of examples 1-7, wherein the tubular housing comprises a widened portion configured to accommodate the rubber bag as the rubber bag expands radially upon impact.

Example 9 includes an anvil that includes a rigid base configured to be coupled to an end of a compression spring disposed within a plunger lubricator of a wellbore, and a flexible damper coupled to the rigid base opposite the compression spring. The flexible damper is configured to dissipate some or all of the kinetic energy from a plunger upon impact from the plunger during a plunger lifting process of the wellbore.

Example 10 includes example 9, wherein the flexible damper comprises a flexible tube comprising bellows that allows the flexible tube to be compressed upon impact.

Example 11 includes any of examples 9-10, wherein the tube comprises a non-metallic, hollow tube.

Example 12 includes any of examples 9-11, wherein the tube is filled with hydraulic fluid.

Example 13 includes any of examples 9-12, wherein the flexible tube comprises an accordion-style tube made of rubber.

Example 14 includes any of examples 9-13, wherein the rigid base comprises a metal plate and the rigid guide rod comprises a metal rod.

Example 15 includes any of examples 9-14, wherein the anvil further comprises a second metal plate comprising an impact surface and coupled to an end of the flexible tube opposite the metal plate.

Example 16 includes any of examples 9-15, wherein the flexible damper comprises a non-metallic housing defining an inner volume configured to house a hydraulic fluid.

Example 17 includes any of examples 9-16, wherein the anvil further comprises a rigid guide rod configured to be disposed at least partially within the compression spring, and wherein the non-metallic housing comprises a rubber bag filled with hydraulic fluid and configured to expand radially upon impact by the plunger.

Example 18 is a method that includes lifting, with production fluid accumulated uphole of a plunger, the plunger within a production string disposed within a wellbore. The lifting comprises lifting the plunger to push the production fluid uphole. The method also includes continuing to lift the plunger until the plunger strikes a flexible anvil coupled to a distal end of a spring of a wellhead lubricator, the flexible anvil configured to dissipate some or all of the kinetic energy from the plunger.

Example 19 includes examples 18, wherein the flexible anvil comprises a flexible tube comprising bellows, and continuing to lift the plunger comprises lifting the plunger until the plunger strikes the flexible tube compressing the bellows of the flexible tube.

Example 20 includes any of examples 18-19, wherein the flexible anvil comprises a rubber bag filled with hydraulic fluid, and continuing to lift the plunger comprises lifting the plunger until the plunger strikes the rubber bag and expand the rubber bag radially for the rubber bag to absorb some or all of the kinetic energy.

What is claimed is:

1. A wellbore assembly, comprising:

a wellhead assembly configured to be coupled to a wellbore string disposed within a wellbore, the wellhead assembly configured to reside at a terranean surface of the wellbore, the wellhead assembly comprising:

a lubricator defining a tubular housing, a spring disposed at least partially within and attached to the tubular housing, the spring comprising a first end attached to the tubular housing, and a flexible damper coupled to a second end of the spring opposite the first end; and a plunger configured to strike, as the plunger is lifted from a downhole location of the wellbore to the terranean surface, the flexible damper, the flexible damper configured deform, upon impact with the plunger, to dissipate some or all of the kinetic energy of the plunger;

wherein the flexible damper comprises at least one of (i) a flexible tube comprising bellows that allows the flexible tube to be compressed upon impact, or (ii) a non-metallic housing defining an inner volume configured to house a hydraulic fluid.

2. The wellbore assembly of claim 1, wherein the tube comprises a non-metallic, hollow tube.

3. The wellbore assembly of claim 1, wherein the tube is filled with hydraulic fluid.

4. The wellbore assembly of claim 1, wherein the flexible damper comprises a rigid impact surface and a guide rod, with the flexible tube attached to and disposed between the guide rod and the impact surface.

5. The wellbore assembly of claim 1, wherein the non-metallic housing comprises a rubber bag filled with hydraulic fluid.

6. The wellbore assembly of claim 1, wherein the lubricator comprises an inwardly projecting shoulder that retains, with the spring in an extended position, an end of the flexible damper, preventing the flexible damper from extending downhole of the inwardly projecting shoulder.

7. The wellbore assembly of claim 1, wherein the flexible damper comprises a passive flexible damper.

8. A wellbore assembly, comprising:

a wellhead assembly configured to be coupled to a wellbore string disposed within a wellbore, the wellhead assembly configured to reside at a terranean surface of the wellbore, the wellhead assembly comprising:

a lubricator defining a tubular housing, a spring disposed at least partially within and attached to the tubular housing, the spring comprising a first end attached to the tubular housing, and a flexible damper coupled to a second end of the spring opposite the first end; and a plunger configured to strike, as the plunger is lifted from a downhole location of the wellbore to the terranean surface, the flexible damper, the flexible damper configured deform, upon impact with the plunger, to dissipate some or all of the kinetic energy of the plunger;

wherein the flexible damper comprises a non-metallic housing defining an inner volume configured to house a hydraulic fluid, the non-metallic housing comprises a rubber bag filled with hydraulic fluid, and wherein the tubular housing comprises a widened portion configured to accommodate the rubber bag as the rubber bag expands radially upon impact.

9. An anvil, comprising:

a rigid base configured to be coupled to an end of a compression spring disposed within a plunger lubricator of a wellbore; and a flexible damper coupled to the rigid base opposite the compression spring, the flexible damper configured to dissipate some or all of the kinetic energy from a plunger upon impact from the plunger during a plunger lifting process of the wellbore;

wherein the flexible damper comprises at least one of (i) a flexible tube comprising bellows that allows the flexible tube to be compressed upon impact, or (ii) a non-metallic housing defining an inner volume configured to house a hydraulic fluid.

10. The anvil of claim 9, wherein the tube comprises a non-metallic, hollow tube.

11. The anvil of claim 9, wherein the tube is filled with hydraulic fluid.

12. The anvil of claim 9, wherein the flexible tube comprises an accordion-style tube made of rubber.

13. The anvil of claim 9, wherein the rigid base comprises a metal plate and a rigid guide rod extending from the metal plate, and the rigid guide rod comprises a metal rod.

14. The anvil of claim 13, further comprising a second metal plate comprising an impact surface and coupled to an end of the flexible tube opposite the metal plate.

15. The anvil of claim 9, further comprising a rigid guide rod configured to be disposed at least partially within the compression spring, and wherein the non-metallic housing comprises a rubber bag filled with hydraulic fluid and configured to expand radially upon impact by the plunger.

16. A method, comprising:

lifting, with production fluid accumulated uphole of a plunger, the plunger within a production string disposed within a wellbore, the lifting comprises lifting the plunger to push the production fluid uphole; and continuing to lift the plunger until the plunger strikes a flexible anvil coupled to a distal end of a spring of a wellhead lubricator, the flexible anvil configured to dissipate some or all of the kinetic energy from the plunger;

wherein the flexible anvil comprises at least one of (i) a flexible tube comprising bellows that allows the flexible tube to be compressed upon impact, or (ii) a non-metallic housing defining an inner volume configured to house a hydraulic fluid, and the continuing to lift comprises lifting the plunger until the plunger strikes one of the flexible tube or non-metallic housing.

17. The method of claim 16, wherein the flexible anvil comprises a flexible tube comprising bellows, and continuing to lift the plunger comprises lifting the plunger until the plunger strikes the flexible tube compressing the bellows of the flexible tube.

18. The method of claim 16, wherein the flexible anvil comprises a rubber bag filled with hydraulic fluid, and continuing to lift the plunger comprises lifting the plunger until the plunger strikes the rubber bag and expands the rubber bag radially for the rubber bag to absorb some or all of the kinetic energy.

* * * * *